US005215437A

United States Patent [19]

TeVelde et al.

[11] Patent Number: 5,215,437

[45] Date of Patent: Jun. 1, 1993

[54] INLET ORIFICE AND CENTRIFUGAL FLOW FAN ASSEMBLY

[75] Inventors: John A. TeVelde, Vernon, Conn.; Edward H. Greitzer, Wayland, Mass.; Jan B. Kennedy, South Windsor, Conn.

[73] Assignee: Carrier Corporation, Syracuse, N.Y.

[21] Appl. No.: 810,079

[22] Filed: Dec. 19, 1991

[51] Int. Cl.[5] ..... F01D 9/04

[52] U.S. Cl. ..... 415/223; 415/182.1; 415/206

[58] Field of Search ..... 415/182.1, 183, 203, 415/204, 206, 208.1, 208.2, 208.3, 211.1, 223

[56] References Cited

U.S. PATENT DOCUMENTS

| | | | |
|---|---|---|---|
| 2,123,657 | 7/1937 | Munk | 170/168 |
| 3,070,287 | 7/1959 | Eck | 230/134 |
| 3,515,498 | 6/1970 | Tomita | 415/182 |
| 3,799,128 | 3/1974 | Small | 123/41.49 |
| 3,903,960 | 9/1975 | Beck et al. | 165/51 |
| 3,937,189 | 2/1976 | Beck | 123/41.49 |
| 4.061.188 | 12/1977 | Beck | 165/122 |
| 4,181,172 | 1/1980 | Longhouse | 165/51 |
| 4,432,694 | 2/1984 | Kuroda et al. | 415/914 |
| 4,890,547 | 1/1990 | Wagner et al. | 98/42.13 |
| 4,927,328 | 5/1990 | Scoates et al. | 415/220 |
| 5,066,194 | 11/1991 | Amr et al. | 415/211.2 |

FOREIGN PATENT DOCUMENTS

| | | | |
|---|---|---|---|
| 84892 | 6/1969 | Denmark | 415/183 |
| 1276858 | 9/1968 | Fed. Rep. of Germany | 415/183 |
| 1503641 | 9/1969 | Fed. Rep. of Germany | 415/182.1 |
| 1503270 | 7/1970 | Fed. Rep. of Germany | 415/182.1 |
| 2063365 | 6/1981 | United Kingdom | 415/228 |

*Primary Examiner*—John T. Kwon

[57] ABSTRACT

An inlet orifice (12) and an inlet orifice (12) and centrifugal fan (21) assembly that promotes fan efficiency and reduces radiated noise. The orifice has an elliptical entry portion (13) and an elliptical diffuser portion (14) that meet smoothly at a throat (16). The major axes of the two ellipses are parallel to the axis of rotation of the fan (12). The relationship between the major and minor axes of the ellipse defining the entry portion (13) and the relationship between the major and minor axes of the ellipse defining the diffuser portion (14) may be the same or different. The major axes of both ellipses may be equal in length or different. Preferred relationships are disclosed. The fan (21) has an outer envelope (22) that is generally cylindrical but with an entry portion (23) that, when assembled with the orifice (12), extends into the diffuser portion (14) of the orifice (12) and has an outer contour that conforms to the contour of the diffuser portion (14). Preferred relationships between certain dimensions of the orifice structure (12) and the fan (21) are disclosed.

3 Claims, 3 Drawing Sheets

INLET ORIFICE AND CENTRIFUGAL FLOW FAN ASSEMBLY

BACKGROUND OF THE INVENTION

This invention relates generally to fans for moving air. More specifically, the invention relates to an improved fan inlet orifice and an inlet orifice and centrifugal flow fan assembly.

As depicted in FIG. 1, a side elevation view vertically sectioned through the fan centerline, many prior art centrifugal fan systems use a circular bell mouthed inlet orifice P12 in an inlet bulkhead P11. Inlet orifice P12 has a sharp trailing edge P16 to direct air from the suction of the fan into the fan blades P21. The orifice ends abruptly, causing the entering air flow to undergo a sudden and substantial change in direction while diffusing significantly. The resultant local adverse pressure gradient causes flow separation before the air enters the fan blades. In a typical orifice and fan configuration, the ratio of fan inlet area to orifice throat area is in the range of two to three but the flow distance between the orifice and fan inlet is only a quarter of that necessary to prevent boundary layer separation.

The result of such a configuration is that the flow profile of the air entering the fan blades is highly nonuniform, with a large region of separated flow P28 as the air enters the fan blades. The separated region is found on the portion of the blades that is nearest the orifice and may extend for up to 35 percent of the span of the blades. Flow through the separated region is either stagnant or recirculating, such as in area P29, and thus only the portion of the fan where flow is unseparated, farthest away from the orifice, is accomplishing useful work. The stagnant or recirculating flow region also is a strong radiated noise source.

Increasing the uniformity of the flow from the orifice into the fan and reducing or eliminating the region of flow where there is flow separation will increase the efficiency of the fan and reduce radiated noise.

Centrifugal and axial fans and their associated inlet orifices are widely used in a number of applications in the field of heating, ventilation and air conditioning (HVAC). An important objective in the design and production of HVAC systems and components is to minimize their physical size. This objective is often at odds with considerations of air flow quality and noise reduction.

SUMMARY OF THE INVENTION

The present invention is an inlet orifice and an inlet orifice and centrifugal fan assembly that promote an attached boundary layer in the air flow throughout the assembly, thus improving fan efficiency and reducing noise while producing the same air flow volume, all without an increase in physical size over a prior art assembly.

In a plane normal to the axis of rotation of the fan, the orifice is circular in cross section. In a plane passing through the axis of rotation of the fan, the orifice has a smoothly curved cross section. The curve is comprised of two quarter ellipsoidal segments joined at the orifice throat. The portion of the fan outer diameter at the end facing the orifice also has an elliptical cross section configured to conform to the curve of the diffuser or outlet portion of the orifice. It is this portion of a conventional centrifugal fan having a purely cylindrical outer envelope that experiences separated flow, thus the invention uses that portion to advantage by contouring it to promote unseparated flow. The clearance between the fan and the orifice should be as small as manufacturing and operational considerations will allow.

Theoretical and experimental data indicate that the ratio of the discharge area of the fan to the inlet area of the orifice should be equal to or less than two. The contour of the exit or diffusion portion of the orifice should be a quarter segment of an ellipse having its major axis parallel to the axis of rotation of the associated fan, that major axis being equal to or greater than 1.4 times the minor axis of the ellipse and that minor axis being in length approximately the difference in length between the throat diameter of the orifice and the outer diameter of the cylindrical portion of the fan. Noise reductions of up to 3.3 dBA are achieved as compared to prior art orifice and fan configurations, with no decrease in air flow rate.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
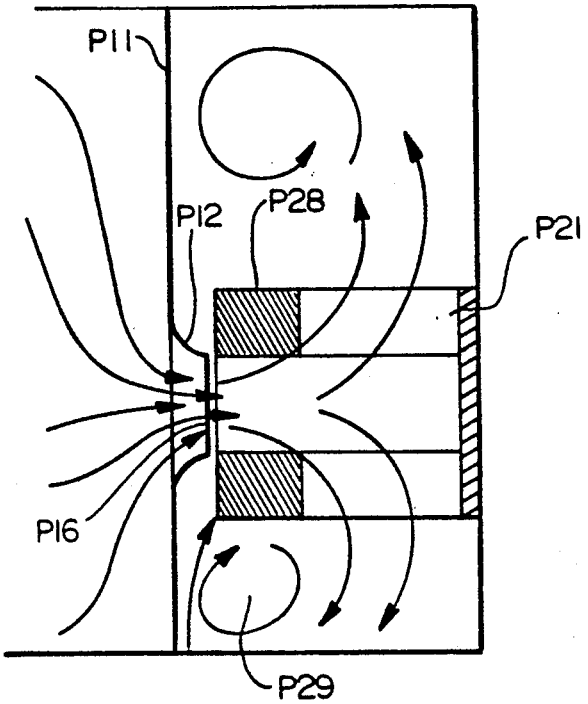
FIG. 1 Prior Art
FIG. 1 is a sectioned side elevation view of a prior art inlet orifice installed in conjunction with a centrifugal flow fan.
Figure 2:
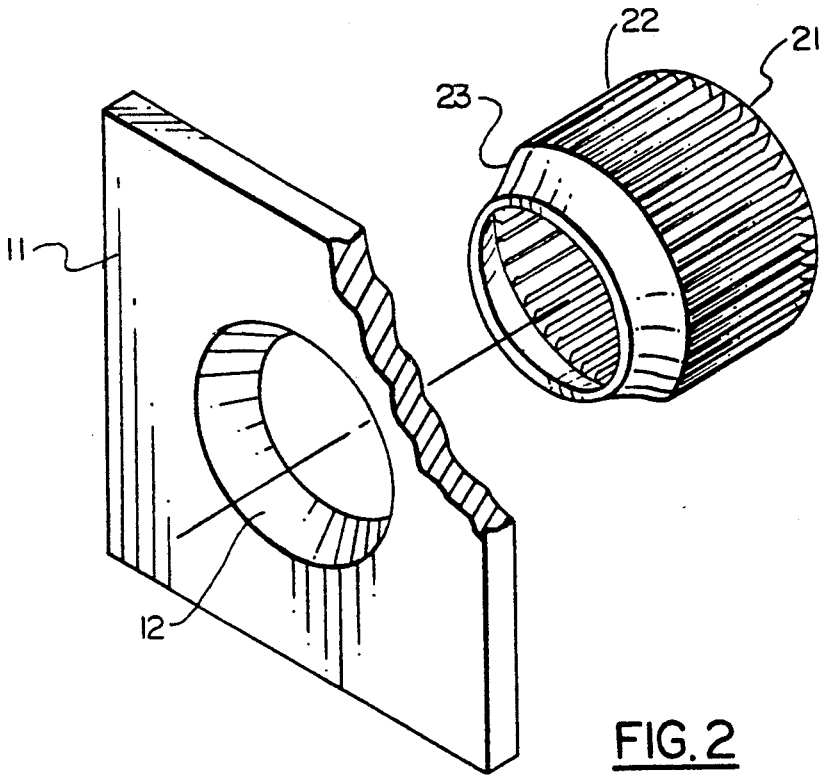
FIG. 2 is an exploded isometric view, partially broken away, of a bulkhead having the inlet orifice and centrifugal flow fan of the present invention.

FIG. 2, in an exploded isometric view, partially broken away, depicts the fan and orifice of the present invention. Inlet bulkhead 11 contains inlet orifice 12. Centrifugal fan 21, generally cylindrical, has an outer end portion 23 that is, in cross section, concavely ellipsoidal. When properly positioned, the axis of rotation of the fan with which inlet orifice 12 is associated passes through the center of the orifice. In a plane passing through the axis of rotation, inlet orifice 12 has a smoothly curved cross section.

Figure 3:
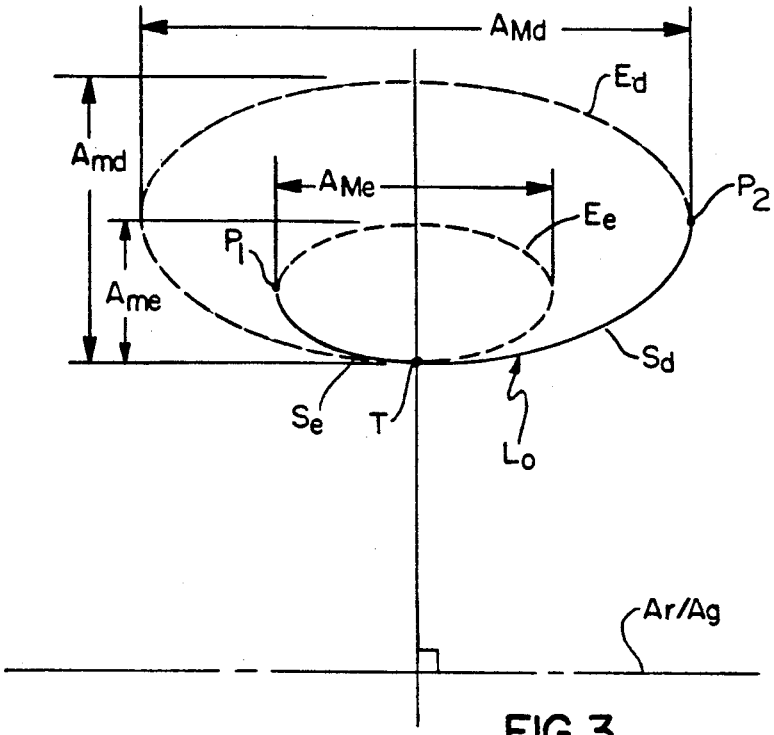
FIG. 3 is a diagram illustrating some of the geometric features of the orifice of the present invention.

The curved surface of inlet orifice 12 may be described as the surface that would be generated by rotating a planar and curvilinear line about a coplanar axis of generation. The fan associated with the orifice will be installed so that the fan axis of rotation is coincident with the axis of generation of the surface of inlet orifice 12. Reference to FIGS. 3 facilitates a description of the curve as well as features of the inlet orifice.

Curve $L_o$ in FIG. 3 is the curve that, when rotated about axis of generation $A_g$, will generate the orifice surface. The salient features of curve $L_o$ are its two ends, points $P_1$ and $P_2$, entry segment $S_e$, exit or diffuser segment $S_d$ and point T, where segment $S_e$ joins segment $S_d$. Entry segment $S_e$ is a quarter segment of the perimeter of ellipsoid $E_e$ and diffuser segment $S_d$ is a quarter segment of the perimeter of ellipsoid $E_d$. Major axis $A_{Me}$ of ellipsoid $E_e$ and major axis $A_{Md}$ of ellipsoid $E_d$ are both parallel to axis of generation $A_g$, which is coincident with fan axis of rotation $A_r$. The minor axes of ellipsoids $E_e$ and $E_d$ are $A_{me}$ and $A_{md}$ respectively.

Point $P_1$, when rotated about axis of generation $A_g$, will generate the leading edge of inlet orifice 12. Point $P_2$, when rotated about axis of generation $A_g$, will generate the trailing edge of inlet orifice 12. Point T, when rotated about axis of generation $A_g$, will generate the throat of inlet orifice 12. Segment $S_e$, when rotated about axis of generation $A_g$, will generate the entry portion of inlet orifice 12. Segment $S_d$, when rotated about axis of generation $A_g$, will generate the diffuser portion of inlet orifice 12.

Figure 4:
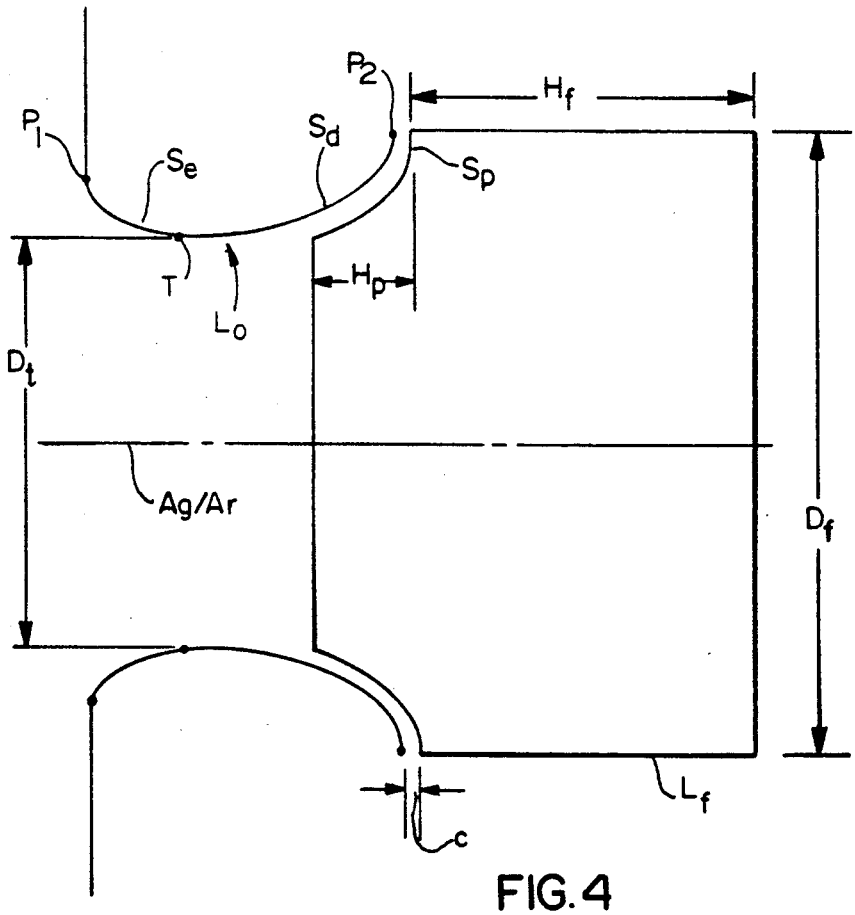
FIG. 4 is a diagram illustrating some geometric features of the orifice and fan of the present invention.

FIG. 4 depicts the relationship between curve $L_o$, as rotated, and the centrifugal fan with which it is intended to operate. The orifice will have a throat diameter $D_t$. The fan has exterior envelope $L_f$. Exterior envelope $L_f$, as is the case with a conventional centrifugal fan, is generally cylindrical but has an end portion $S_p$ that has an ellipsoidal contour conforming to the contour of diffuser segment $S_d$. When assembled, end portion $S_p$ extends into inlet orifice 12 a distance $H_p$. The cylindrical portion of envelope $L_f$ has diameter $D_f$ and span $H_f$. Ideally, to prevent leakage, there should be no clearance between the inlet orifice and the fan. This is a practical impossibility and hence there is a clearance C between the two components. This clearance should be as small as manufacturing and operational considerations allow.

Figure 5:
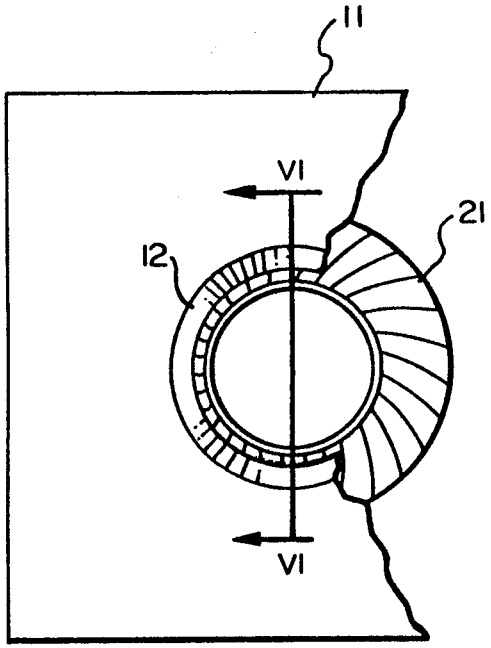
FIG. 5 is a front elevation view, partially broken away, of the orifice and fan of the present invention.

FIG. 5 is a front elevation view, partially broken away, of inlet bulkhead 11, containing inlet orifice 12, and fan 21.

Figure 6:
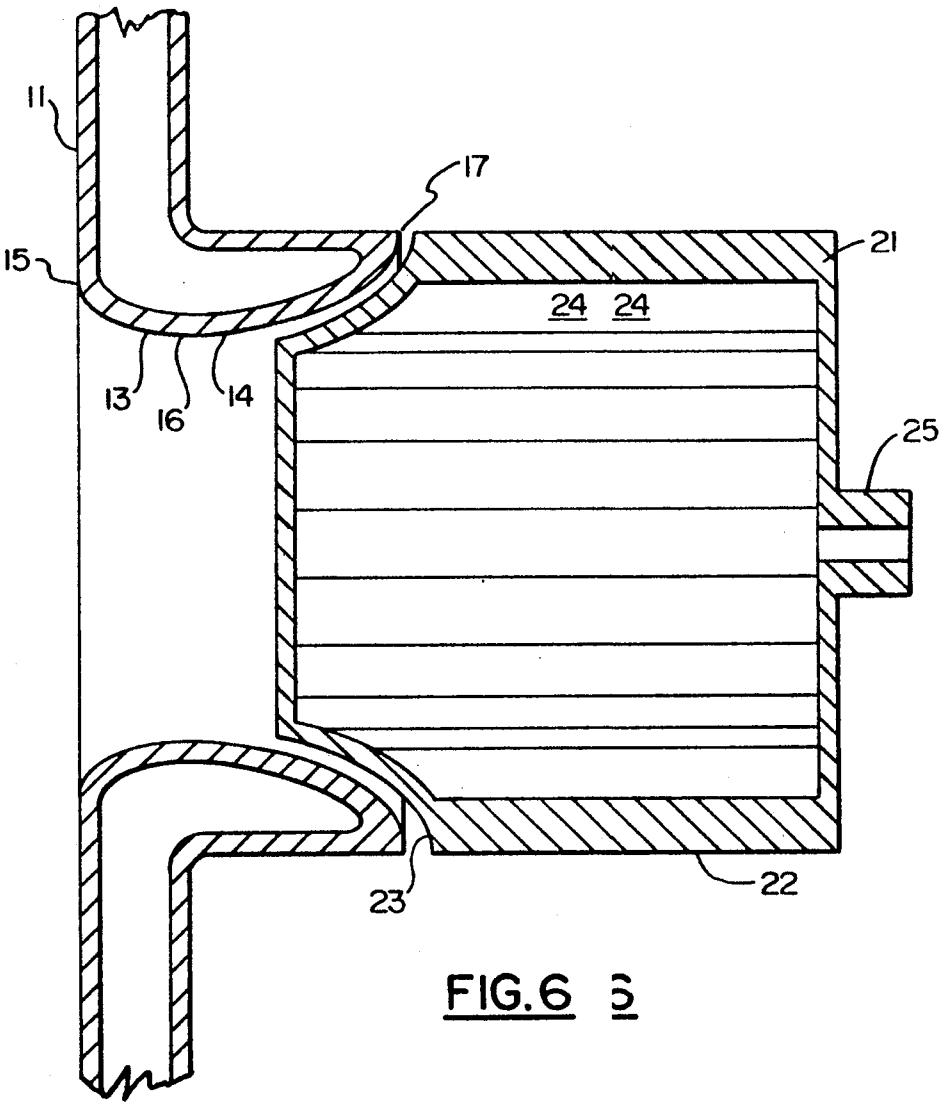
FIG. 6 is a sectioned, through line VII—VII in FIG. 5, side elevation view of the orifice and fan of the present invention.

FIG. 6 is a sectioned, through line VI—VI in FIG. 5, side elevation view of bulkhead 11, containing inlet orifice 12, and fan 21. In FIG. 6 are shown leading edge 15, entry section 13, throat 16, diffuser section 14 and trailing edge 17 of inlet orifice 12. Also shown are cylindrical portion 22 and elliptical portion 23 as well as a representative blade 24 and shaft sleeve 25 of fan 21.

Certain relationships between the dimensions of inlet orifice 12 and fan 21 yield preferred results in the performance of the two operating together:

(1) the ratio of the surface area of the cylindrical portion of the fan envelope or discharge area of the fan $A_o$, to the throat or inlet area of the orifice, $A_i$, should be equal to less than two, or $$A_o/A_i \leqq 2,$$

where $A_o = \pi D_f H_f$ and $A_i = \pi D_t^2/4$;

(2) the minor axis of the ellipse that defines the shape of the diffuser portion of the inlet orifice should be approximately equal to the difference between the diameter of the cylindrical portion of the fan and the throat diameter of the inlet orifice, or $$A_{md} \approx D_f - D_t;$$

(3) the ratio of major axis to minor axis for both the ellipse that defines the orifice entry portion and the ellipse that defines the orifice diffuser portion should be equal to or greater than 1.4, or $$A_{Me}/A_{me} \geqq 1.4 \text{ and}$$

$$A_{Md}/A_{md} \geqq 1.4;$$

(4) the ratio between the major and minor axes of one ellipse may be but need not be the same as the ratio of the major and minor axes of the other ellipse; and (5) the clearance between orifice and fan should be as small as manufacturing and operating tolerances will allow, preferably, in a typical HVAC application, less than 6 mm (0.25 inch), or $$C \leqq 6 \text{ mm } (0.25 \text{ inch}).$$

What is claimed is:

1. A fan (21) and fan orifice (12) assembly comprising:
- an orifice structure (12) comprising a surface having
  - an axisymmetric leading edge (15),
  - an axisymmetric throat (16) in downstream air flow relationship with said leading edge,
  - an entry portion (13) extending from said leading edge to said throat,
  - said entry portion being in form like the surface produced by rotating a first planar line about a coplanar axis of generation,
    - said first planar line being a generally quarter segment of a first ellipsoid having a major axis substantially parallel to said axis of generation,
- an axisymmetric trailing edge (17) in downstream air flow relationship with said throat and
- a diffuser portion (14) extending from said throat to said trailing edge,
  - said diffuser portion being in form like the surface produced by rotating a second planar line about a coplanar axis of generation,
    - said second planar line being a generally quarter segment of a second ellipsoid having a major axis substantially parallel to said axis of generation; and
- a fan (21) of the centrifugal flow type having
  - an axis of rotation that, when assembled together with said orifice structure, is coincident with said axis of generation of said orifice structure,
  - a generally cylindrical outer envelope (22) having
    - a discharge area that is equal or less than two times the inlet area of said fan orifice and
    - a diameter that is approximately equal to the sum of said minor axis of said second ellipsoid and the diameter of said throat and
  - an end portion (23) that, when assembled together with said orifice structure, extends into said orifice structure diffuser portion and has a contour that generally conforms to the contours of said diffuser portion.

2. The fan and fan orifice assembly of claim 1 in which the ratio of the major axis to the minor axis of said first ellipsoid and the ratio of the major axis to the minor axis of said second ellipsoid are both equal to or greater than 1.4.

3. The fan and fan orifice assembly of claim 1 in which the clearance between said orifice and said fan is less than six millimeters (0.25 inch).

* * * * *